US005512064A

United States Patent [19]

von der Eltz et al.

[11] Patent Number: 5,512,064

[45] Date of Patent: Apr. 30, 1996

[54] PROCESS FOR MODIFYING AND DYEING MODIFIED FIBER MATERIALS

[75] Inventors: Andreas von der Eltz; Joachim Clauss; Andreas Schrell, all of Frankfurt am Main, Germany

[73] Assignee: Hoechst AG, Germany

[21] Appl. No.: 281,840

[22] Filed: Jul. 28, 1994

[30] Foreign Application Priority Data

Jul. 31, 1993 [DE] Germany ..... 43 25 783.6

[51] Int. Cl.[6] ..... D06M 15/61; D06M 15/53; D06P 1/38

[52] U.S. Cl. ..... 8/541; 8/542; 8/551; 8/608; 8/181; 8/116.4; 8/115.65; 8/DIG. 17; 8/922; 8/924; 8/926; 8/918; 8/543

[58] Field of Search ..... 8/551, 594, 582, 8/608, 597, 181, 196, 116.4, 127.6, 129, 115.65, 532, 543, 917–924, DIG. 17, 541, 542

[56] References Cited

U.S. PATENT DOCUMENTS 3,787,173 1/1974 Greenshields et al. ..... 8/551 X 4,806,126 2/1989 Sternberger et al. ..... 8/543

FOREIGN PATENT DOCUMENTS 30786 6/1981 European Pat. Off. .

3544795 6/1987 Germany .

1409568 10/1975 United Kingdom .

OTHER PUBLICATIONS

Melvin D Hurwitz et al, "Dialdehydes as Cotton Cellulose Cross–Linkers" Textile Research Journal Mar. 1958, pp. 257–262.

*Primary Examiner*—Margaret Einsmann

*Attorney, Agent, or Firm*—Connolly & Hutz

[57] ABSTRACT

Fiber materials are modified with a polyalkyleneimine polymer at crosslinking agent, preferably glyoxal, and optionally dyed with water-soluble, anionic dyes, preferably reactive dyes. The dyeing process with fiber materials modified according to the invention can be carried out low-salt or completely without salt and also alkali-free or using only minimal amounts of alkali.

17 Claims, No Drawings

PROCESS FOR MODIFYING AND DYEING MODIFIED FIBER MATERIALS

Conventional processes for dyeing cellulose-containing substrates with anionic dyes involve the use of urea, electrolyte salts and alkali. Only in the alkaline region is cellulose sufficiently nucleophilic for reaction with reactive dyes. Urea and electrolyte salts are required for enhancing the substantivity of the dyes. Amino-containing fiber materials are already sufficiently nucleophilic at neutral pH for reaction with reactive dyes. Dyeings with direct and acid dyes are carried out at a weakly acid pH in the presence of electrolyte in order that the anionic dyes go efficiently onto the substrate. The waste waters obtained at the end of the dyeing processes mentioned contain large amounts of the auxiliaries mentioned and are frequently no longer acceptable from an ecological point of view.

It is therefore the object of the present invention to devise a process for dyeing (including printing) textile fiber materials using very small amounts of electrolyte salts, such as sodium chloride and sodium sulfate, if any electrolyte salts at all, and at the same time only a minimal amount of an alkaline agent, such as sodium carbonate, sodium hydroxide or sodium silicate, if any. A dyeing process which can be carried out with little or no salt and at the same time little or no alkaline agent is advantageous particularly with regard to the dyeing processes using fiber-reactive dyes because the fixation of the fiber-reactive dye in the aqueous, frequently strongly alkaline, dyeing liquor may be accompanied by hydrolysis reactions on the fiber-reactive dye, which is why fixation on the fiber material is not complete. For this reason the dyeing process has to be followed by, in some instances, extensive and time-intensive washing and rinsing processes, such as the repeated rinsing with cold and hot water and an in-between neutralization treatment to remove excess alkali from the dyed material and further, for example, by a boil wash with a nonionic detergent in order that the good fastness properties of the dyeing may be ensured.

It is already known (see Text. Res. J. 17 (1947), 645; loc. cit. 23, 522 (1953) and 39, 686 (1969) and CA-A-20 84 585 that cellulose can be modified with aminoethylsulfuric acid via the stage of ethyleneimine and then dyed with direct dyes. Continuing work showed later (see Melliand Textilber. 6, 641 (1964)) that thus modified fibers can also be dyed with monochlorotriazine dyes. However, the alkaline solutions used in these known processes for the treatment of the cotton were in all cases 25% strength with respect to sodium hydroxide, and the liquor pickup of the impregnated fabric was more than 100% by weight. A prolonged predrying step was followed by fixation at temperatures above 100° C. over several minutes. This way of modifying cotton is extremely uneconomical; nor is it possible to dye the textile fabrics thus treated level and produce goods of a uniform appearance.

AU 41215/89 and U.S. Pat. No. 4,806,126 disclose pretreating textiles with alkylated polyethyleneimines to obtain unlevel dyeings having a denim effect. The toxicity of the alkylating agent used is beyond question and complete, residueless removal of these agents is an absolute prerequisite.

CH-A-574 536describes reaction products of polyethyleneimine with dicyandiamide or cyanamide and the fixation thereof. U.S. Pat. No. 3,787,173 likewise pretreats with polyimines and polyamines, but dyes immediately thereafter with fiber-reactivedyes. Here exhaust dyeings lead to undesirable flocculation, since the polyamines and polyimines are redetachable from the fiber and then react and flocculate with the dyes.

The present invention now provides that anionic textile dyes, in particular those having fiber-reactive groups, will surprisingly give level and strong dyeings having good service fastness properties without or only with minimal use of alkaline agents and electrolyte salts provided the textile material used is a fiber material which has been modified by pretreatment with a polymeric compound which contains at least one secondary or primary amino group and has been crosslinked on the fiber by a suitable bifunctional compound and thereby rendered water-insoluble.

The present invention accordingly provides a process for modifying fiber materials, which comprises contacting the fiber material with a polymer which contains at least one primary or secondary amino group and has the formula (I)

$$(\text{—A—X—A—})_n \qquad \text{(I)}$$

where

A is a chemical bond or a methylene group,

X is a group of the formula $(\text{—CH}_2\text{—})_m$, $\text{—CH}_2\text{—NR}^1\text{—CH}_2\text{—}$ or $\text{—CH}_2\text{—O—CH}_2\text{—}$ wherein m is from 1 to 6, preferably from 1 to 4, and $R^1$ is hydrogen or $C_1$–$C_4$-alkyl, and n is from 2 to 1000, preferably from 10 to 500, and identical or different groups X can be joined together in any desired order, and with a bifunctional crosslinking agent of the formula (II)

$$\text{Z—Q—Z} \qquad \text{(II)}$$

where

Z is a group of the formula —CHO, $\text{—CH(OR}^1)_2$, $\text{—COOR}^1$, —COCl or $\text{—SO}_3\text{Cl}$, wherein $R^1$ is in each case identically or differently hydrogen or $C_1$–$C_4$-alkyl, and Q is a phenylene group or a group of the formula $(\text{—CH}_2\text{—})_a$, wherein a is from 0 to 4, preferably from 0 to 2.

The number of primary or secondary amino groups in the polymer of the formula (I) is preferably from 10 to 500.

The spacing of the amino groups in the polymer can be varied within wide limits by means of in-between alkylene or alkyleneoxy groups. Preferred polymers of the formula (I) are polyethyleneimines having a molecular weight of from 500 to 2000 and polypropyleneimines having a molecular weight from 500 to 1000.

Preferred bifunctional crosslinking agents of the formula (II) are glyoxal, oxalic acid, malonic acid, succinic acid, diethyl oxalate, diethyl malonate and diethyl succinate. Dialdehydes can also be present as acetals or hemiacetals.

Fiber materials for the purposes of the present invention are natural and synthetic materials which contain hydroxyl and/or carboxamide groups, such as silk, wool and other animal hairs and also synthetic polyamide fiber materials and polyurethane fiber materials, for example nylon-4, nylon-6 and nylon-11, and especially fiber materials which contain the repeat unit of α,β-glucose, such as cellulose fiber materials, for example, cotton, hemp, jute and linen, and their regenerated derivatives, such as rayon and staple viscose, or mixtures thereof.

In the fiber material modification process of the invention, a) the fiber material is contacted with a mixture of a polymer of the formula (I) and of a compound of the formula (II) in aqueous or aqueously alkaline solution, or b) the fiber material is contacted first with a polymer of the formula (I) and then with or without intermediate drying with a compound of the formula (II).

The invention further provides a process for dyeing the fiber material modified according to the invention. The term "dyeing" comprehends not only dyeing processes but also processes for printing fiber materials. In the process for modifying and dyeing the fiber material according to the invention, a) the fiber material is contacted with a mixture of a polymer of the formula (I) and of a compound of the formula (II) in aqueous or aqueously alkaline solution prior to dyeing, or b) the fiber material is contacted first with a polymer of the formula (I) and then with or without intermediate drying with a compound of the formula (II), in which case optionally the dye is applied together with the compound of the formula (II) or in a subsequent separate step. The treatment agents and the dye are applied to the fiber material by an exhaust method or padding method, by spraying or by means of an inkjet process.

The compounds of the formulae (I) and (II) and the dye are in solution in water, but it may be necessary to add to the aqueous solution a small amount of alkali, electrolyte or of other customary additives, for example wetting agents (surfactants). The concentration of the polymers of the formula (I) in the aqueous treatment solution is advantageously from 1 to 30% by weight, preferably from 2 to 20% by weight, and that of the compounds of the formula (II) from 0.5 to 20% by weight, preferably from 1 to 10% by weight. To prevent an excessively rapid reaction between the compounds of the formulae (I) and (II), the solution can be cooled and/or rendered alkaline. This is advantageously done with $Na_2CO_3$ or NaOH. The concentration of the alkali in the treatment solution ranges from 0 to 20% by weight, preferably from 0 to 5% by weight, and depends on the solution stability to be achieved. The lower the level of compounds of the formulae (I) and (II) in the solution, the better the stability of the mixtures even without additives.

The treatment solution and the dye solution are advantageously brought into contact with the fiber material at temperatures between and 10° and 100° C., preferably between 20° and 50° C.

The fiber material, which not only is modified according to the invention but also used in the dyeing process in the modified form, can be present in any state of processing, for instance as yarn, staple, slubbing and piece goods (fabrics) and also in mixture with other fiber materials, for example in the form of cotton-polyester fiber materials and in the form of blend fabrics with other fiber materials.

If the impregnation of the fiber material with an alkaline aqueous solution is effected by introducing the fiber material into this solution or by padding (slop-padding), the excess liquor is subsequently squeezed off in such a way that the pickup of this aqueous, alkaline solution by the impregnated material is between 50 and 20% by weight, preferably between 70 and 100% by weight, based on the fiber material. Generally the impregnating (by slop-padding, nip-padding or treatment in solution itself) is carried out at a temperature between 10° and 60° C., preferably at a temperature between 15° and 30° C. If the solution is sprayed onto the fiber material, which generally takes place at a temperature between 10° and 40° C., the wet pickup is preferably set at between 10 and 50% by weight.

After the fiber material has been impregnated in one of the various ways specified above, the impregnated material can be dried, in which case the drying is carried out at a temperature between 20° and 100° C., preferably between 30° and 50° C. Drying is generally effected by treatment with hot air for from 0.5 to 3 minutes. However, the fiber material can also be further processed moist directly after the reaction with the compounds of the formulae (I) and (II).

The customary aftertreatment of the modified fiber material is by rinsing with cold and hot water and optionally by treating in an aqueous bath containing a small amount of a surfactant to remove only superficially adhering compounds from the fiber material and possibly subsequent drying. Ideally the fiber material to be introduced into the dyeing process should give a neutral reaction.

The dyeing of such modified fiber materials according to the invention is carried out similarly to the known methods of dyeing and printing fiber materials with water-soluble textile dyes, such as anionic dyes, especially fiber-reactive dyes, using the customary temperature ranges and dye quantities, except with the exception according to the invention that for the dyebaths, padding liquors and print pastes of the dyeing processes according to the invention an addition of alkaline compounds as customarily used for fixing fiber-reactive dyes, for example sodium carbonate, potassium carbonate, sodium hydroxide and sodium silicate, can be essentially or even completely ruled out and, furthermore, the customary addition of electrolyte salts, which are intended to enhance especially the migration of the dye on the fiber, is not required at all or only required to a small degree, for example at up to not more than 10 g per liter of dyebath or dyeing liquor. The dyeing process of the invention accordingly takes place within a pH range between 4 and 8, preferably between 4.5 and 7.

Dyeing processes for use according to the invention include for example the various exhaust method processes, such as dyeing on the jigger and on the reel beck or dyeing from long or short liquor, dyeing in jet dyeing machines, dyeing by the cold pad-batch or by a pad-steam fixation process. For exhaust dyeing the liquor ratio can be within the customary range from 3:1 to 20:1. The dyeing temperature can be between 30° and 90° C., it is preferably below 60° C.; as follows from the abovementioned use of the cold pad-batch process according to the invention, dyeing is advantageously also possible at room temperature (at from 10° to 30° C.).

In the dyeing process of the invention, the use of the customary, frequently necessary, dyeing assistants, such as surfactants (wetting agents), thiourea, thiodiethylene glycol, thickeners, leveling aids, auxiliaries which improve the solubility of dyes in the concentrated padded liquors, for example condensation products of formaldehyde and optionally alkyl-substituted naphthalene-sulfonic acids, and especially urea, can be dispensed with completely or to an appreciable extent. Generally the modified fiber material according to the invention can be dyed merely using purely aqueous dye solution in which have been additionally dissolved only extremely small amounts of electrolyte salts (such as sodium chloride and sodium sulfate), which are present in the dye powders as colorless diluents.

The present invention can advantageously also be used for single-bath dyeing processes for dyeing mixtures of cellulose and polyester fibers if a disperse dye suitable for dyeing polyester fiber materials is used in addition, together with a reactive dye, in a common dyebath. Since many disperse dyes are alkali-sensitive especially when applied at higher temperatures, they cannot be used in the single-bath dyeing of cellulose-polyester blend fiber materials, since the use of the high temperatures in the alkali-containing bath in the dyeing of the polyester fiber by the disperse dye leads to damage to the disperse dye. However, the present invention makes it possible to dye alkali-free, so that the reactive dye can be fixed on the modified fiber material in the aqueous alkali-free dyeing liquor initially at a low temperature, for example at a dyeing temperature between 30° and 80° C., and subsequently the polyester fiber is dyed with the disperse dye in a conventional manner at temperatures above 100° C., for example between 110° and 140° C.

The dyeing process of the invention can apply any water-soluble, preferably anionic, dyes which preferably have one or more sulfo and/or carboxyl group and may optionally contain fiber-reactive groups. As well as to the class of the fiber-reactive dyes they can belong to the class of the azoic dyes, the direct dyes, the vat dyes and the acid dyes, which can be for example azo dyes, copper complex, cobalt complex and chromium complex azo dyes, copper and nickel phthalocyanine dyes, anthraquinone, copper formazan, azomethine, nitroaryl, dioxazine, triphendioxazine, phenazine and stilbene dyes. Such dyes are numerously described in the literature, for example in CA-A-20 68 267 and completely familiar to the person skilled in the art.

The dyeings obtainable according to the invention on the modified cellulose fiber materials require no further aftertreatment, especially no extensive aftertreatment process including a wash, after removal from the dyebath or after completion of the fixation of the dye on the substrate. It is generally sufficient to rinse the dyed substrate one or more times with warm or hot and optionally cold water, which may optionally contain a nonionic wetting agent or a fiber-reactive aftertreating agent, for example condensation products of one mole of cyanuric chloride and two moles of 4-(β-sulfatoethylsulfonyl)aniline, of equivalent amounts of cyanuric chloride, 4-(β-sulfatoethylsulfonyl)aniline and 4,8-disulfo-2-aminonaphthalene or of equivalent amounts of cyanuric chloride, 4-sulfoaniline and 4,8-disulfo-2-aminonaphthalens. The use of a fiber-reactive aftertreating agent is advisable when the fiber material modified according to the invention was dyed only in pale depths of shade or the dye used does not possess satisfactory fiber-reactivity. In these cases there are still a sufficient number of dyeing-active sites present on the modified fiber which are capable of reacting for example with other dyes in rinse baths contaminated with these dyes. This aftertreatment deactivates the still active sites of the fiber modified according to the invention, giving even in the case of an industrial process rinse water, contaminated with dyes, the originally desired bright dyeing. Nor is a final boil treatment of the dyed substrate with a wash solution for improving the fastness properties necessary.

In cases where an oversupply of dye, as for example in printing, causes staining of white, undyed material, diethanolamine or ammonia are introduced into the wash liquor after the fixing step. This improves the wash properties (staining) of the material, since these additives lead to distinctly reduced staining effects.

In contradistinction to the existing processes for modifying cotton, the use of alkali is unnecessary; similarly, the fixing times can be dramatically shortened. Furthermore, the novel process for dyeing fiber materials modified according to the invention makes possible, especially in the exhaust process, the single dyeing of polyester-cotton blend fabrics with reactive and disperse dyes without any damage to the disperse dye being possible, precisely because there is no alkali present in this single-bath dyeing process.

The process of the invention is advantageous from ecological and economic aspects, since the impregnating and the dyeing can be carried out in a simple manner and the polymers of the formula (I), if not present with the compound of the formula (II) in the same solution, can be concentrated and regenerated from the aqueous solution.

The present invention also provides a fiber material modified by the process of the invention and a fiber material modified and dyed according to the invention.

The invention further relates to the use of such more particularly above-defined amino-containing polymers and crosslinking agents for modifying fiber materials, especially for the purpose that these can be used for dyeing with water-soluble, anionic dyes without or only with small amounts of electrolyte salts and alkaline agents.

The Examples which follow illustrate the invention. Parts and percentages are by weight, unless otherwise stated. Parts by weight may have the same relationship to parts by volume as the kilogram to the liter. "MW" means average molecular weight.

EXAMPLE 1 a) A fabric of mercerized and bleached cotton is impregnated with a solution of 10% of polyethyleneimine (MW: 1000) in water by immersion for 5 minutes. The fabric is then squeezed off to 80% liquor pickup and immersed for 5 minutes in a solution of 2% of glyoxal in water. Each dip must be carried out with good liquor circulation, since unlevel results are otherwise likely. After the dip the fabric is again squeezed off to 80% liquor pickup and then dried at 45° C.

b) The modified cotton fabric is dyed analogously to a customary exhaust dyeing process: 100 parts of the modified fabric are introduced into 2000 parts by volume of an aqueous dye solution which contains 2 parts of a 50% strength electrolyte(predominantly sodium chloride)-containing dye powder of the dye of the formula

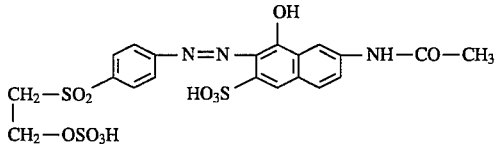

known from EP-A-0 061 151 in the form of the alkali metal salt (i.e. 1 part of this dye and 1 part of the electrolyte) in solution, the dyebath is heated over 30 minutes to 60° C. and the dyeing process is continued at that temperature for 60 minutes. The dyed fabric is then rinsed with cold water and with hot water with or without a commercial wetting agent, if necessary rinsed once more with cold water, and dried.

The result obtained is a strong, uniformly dyed orange dyeing which has good all round fastness properties.

EXAMPLE 2 a) A fabric of mercerized and bleached cotton is padded with a solution of 5% of polyethyleneimine (MW: 2000) in a pad-mangle to 80liquor pickup. The fabric is then over, added with a solution of 2% of glyoxal in water. The fabric thus obtained is dried at 30° C. in the circulating air cabinet.

b) The modified cotton fabric is dyed by a cold pad-batch process. For this an aqueous dye solution which in 1000 parts by volume contains 20 parts of the dye powder described in Example 1, 100 parts of urea and 3 parts of a commercial nonionic wetting agent in solution is applied to the fabric by means of a pad-mangle at 25° C. to a liquor pickup of 80%, based on the weight of the fabric. The fabric padded with the dye solution is wound up on a batching roller, wrapped in a plastic film and left for 16 hours at 20° to 25° C., and is then rinsed with cold water and with hot water with or without a commercial wetting agent and if necessary subsequently once more with cold water and dried.

The result obtained is a strong, uniformly dyed orange dyeing having good all round fastness properties, in particular good crock and light fastness properties.

EXAMPLE 3 a) A fabric of mercerized and bleached cotton is padded with the mixture of a solution of 3% of polyethyleneimine (MW: 1000) and 1% of glyoxal in water in a pad-mangle to 80% liquor pickup. The fabric thus obtained is dried at 60° C.

b) The fabric thus modified is dyed by a conventional padding process, for example analogously to the procedure of Example 2. For this an aqueous dyeing liquor containing per 1000 parts by volume 28 parts of a 50% strength electrolyte(predominantly sodium chloride)-containing dye powder of the dye of the formula

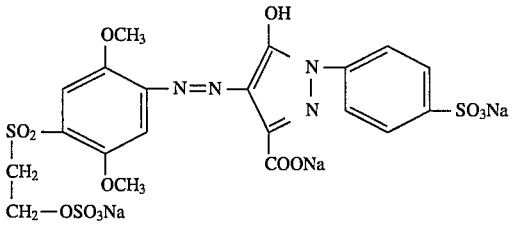

known from Belgian Patent No. 715 420 and 3 parts of a commercial nonionic wetting agent in solution is applied to the fabric at 20° C. by means of a pad-mangle to a liquor pickup of 80%, based on the weight of the fabric. The padded fabric is then wound up on a batching roller, wrapped in a plastic film and left for eight hours at 30° to 40° C., and is then washed with cold water and with hot water with or without a commercial nonionic surfactant and if necessary once more with cold water and dried.

The result obtained is a strong, uniformly dyed yellow dyeing having the usual good fastness properties.

EXAMPLE 4 a) A fabric of mercerized and bleached cotton is padded with the mixture of a solution of 10% of polyethyleneimine (MW: 500) into which 4% of $Na_2CO_3$ had been given beforehand and 4% of glyoxal in water in a pad-mangle to 80% liquor pickup. The fabric thus obtained is dried at 50° C. in a circulating air cabinet.

b) The dried material thus modified is dyed in a conventional exhaust process. For this 10 parts of this material are introduced into 200 parts by volume of an aqueous dye solution containing 0.2 part of a 50% strength electrolyte-containing dye powder of the dye of the formula

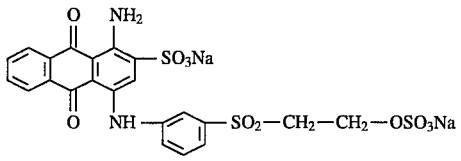

known from German Offenlegungsschrift No. 2 412 964 in solution. The dyeing takes place at 60° C. over 60 minutes. The dyed fabric is then rinsed with cold water and with 30° to 35° C. water with or without a commercial nonionic surfactant, then if necessary washed once more with cold water, and dried.

EXAMPLE 5

A fabric of mercerized and bleached cotton is printed with a mixture consisting of a solution of 5% of polyethyleneimine (MW: 2000) into which 4% of $Na_2CO_3$ had been added beforehand and 4% of glyoxal in water using a commercial inkier printer operating according to a non-thermal process (e.g. piezo). The printing can be done uniformly over the entire fabric or else only in patterns. In the case of a patterned print the result after the dyeing are colored patterns on white ground. The fabric thus obtained is dried at 50° C. in the circulating air cabinet.

A cotton fabric modified according to the above indications is dyed by cold pad-batch process. For this an aqueous dye solution containing per 1000 parts by volume 20 parts of a 50% strength electrolyte-containing dye powder of the copper phthalocyanine dye of the formula

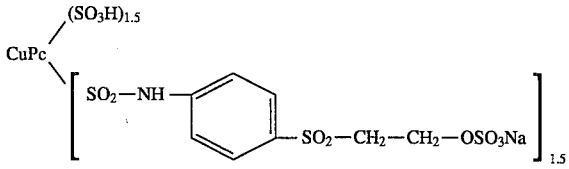

known for example from German Patent No. 1 179 317 and 3 parts of a commercial nonionic wetting agent in solution is applied to the fabric at 25° C. by means of a pad-mangle to a liquor pickup of 80%, based on the weight of the fabric. The fabric padded with the dye solution is wound up onto a batching roller, wrapped in plastic film and left for 16 hours at 20° to 25° C. and is thereafter washed with cold water and with hot water with or without a commercial wetting agent and if necessary once more with cold water and dried.

The result obtained is a strong, uniformly dyed turquoise-colored dyeing which has good allround fastness properties, in particular good crock and light fastness.

EXAMPLE 6 a) A fabric of mercerized and bleached cotton is dipped into a mixture of a solution of 5% of polyethyleneimine (MW: 1000) and 1% of glyoxal in water (for example in a jigger). The fabric thus obtained is dried at 50° C. in a circulating air cabinet.

b) A cotton fabric thus modified is printed with an aqueous print paste containing per 1000 parts 20 parts of the dye of the formula

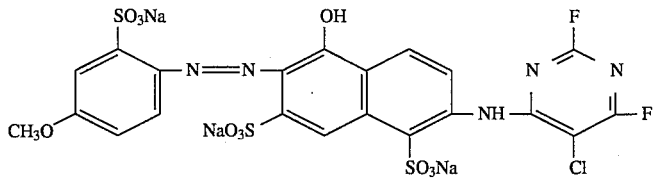

(known from Example 258 of German Offenlegungsschrift No. 1 644 204) and 400 parts of an approximately 4% strength aqueous sodium alginate thickening. The printed cotton fabric is initially dried at from 60° to 80° C. and then steamed for 5 minutes with hot steam at from 101° to 103° C., thereafter treated by rinsing with cold water and with hot water, by boiling treatment in a neutral bath containing a nonionic detergent, again rinsed with cold and hot water, and dried. The result obtained is a uniform, scarlet-colored print which has good use fastness properties.

EXAMPLE 7

A cotton fabric modified according to the indications of Example 4a) is printed with an aqueous print paste containing per 1000 parts 20 parts of the dye of the formula

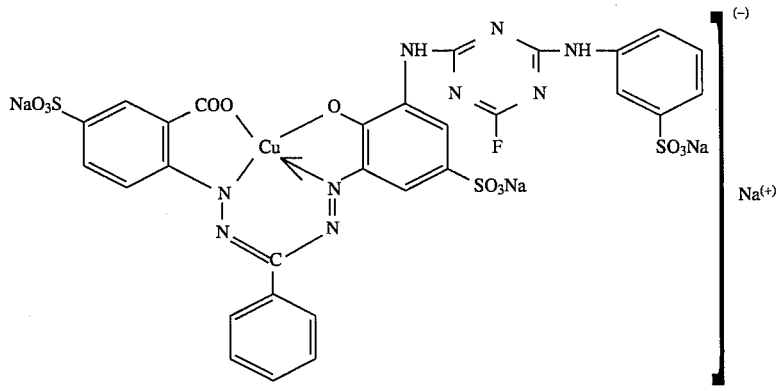

(known from Example 3 of German Offenlegungsschrift No. 2 557 141) and 400 parts of an aqueous, 4% strength sodium alginate thickening. The printed fabric is initially dried at about 60° to 80° C. and then steamed for 5 minutes with superheated steam at from 101° to 103° C. The print obtained, which is finished according to the indications of Example 6, exhibits a brilliant, blue printed pattern which has good allround fastness properties, in particular good crock and light fastness properties.

EXAMPLE 8

10 parts of a cotton fabric modified according to the indications of Example 1a) is introduced into 200 parts of an aqueous solution of 0.2 part of the dye of the formula

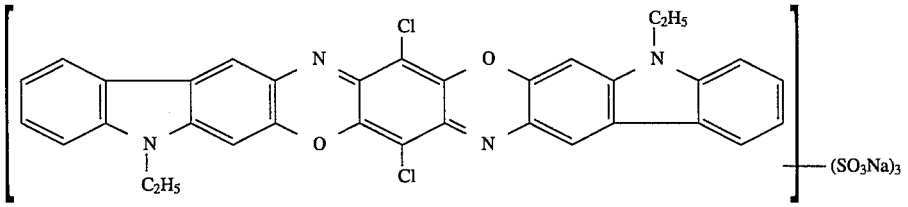

(known from Colour Index under C.I. No. 51320). The cotton fabric is dyed in this dye solution at 60° C. for 60 minutes. The aftertreatment of the dyeing obtained is effected in a conventional manner, for example analogously to the indications of Example 6. The result obtained is a strong blue dyeing which has very good use fastness properties, in particular a good wash fastness.

EXAMPLE 9

10 parts of cotton fabric modified according to the indications of Example 3a) are introduced into 200 parts of an aqueous solution of 0.2 part of the copper phthalocyanine dye of the formula

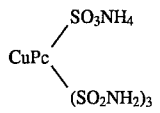

known for example from British Patent No. 1 046 520 and dyed for 60 minutes at a dyeing temperature of 80° C. The dyeing obtained is then rinsed with cold water and with 30° to 35° C. water with or without a commercial nonionic surfactant and subsequently once more rinsed with cold water and dried. The result obtained is a high quality turquoise-colored dyeing having good fastness properties.

EXAMPLE 10 a) 100 parts of a cotton tricot are treated in a jet apparatus with continuous fabric circulation with 1500 parts of an aqueous liquor of 75 parts of polyethyleneimine (MW: 1000) and 45 parts of glyoxal by allowing the liquor to act on the material at that temperature for 30 minutes. The liquor is then discharged from the apparatus and the material thus modified is thoroughly rinsed in the apparatus first with cold water, then with hot water, to which a commercial wetting agent can be added, and subsequently once more with cold water.

b) The jet dyeing apparatus is then charged with 2000 parts of water which are heated to 60° C. Over 60 minutes a total of 20 parts of a 50% strength electrolyte(predominantly sodium chloride)-containing dye powder of the azo dye described in Example 5 of EP-A-0 144 766 are added, the dyeing is then continued for about a further 5 minutes, and then the colorless residual liquor is discharged from the apparatus. The dyed tricot is finished by rinsing with cold and hot water, by boiling treatment in a bath containing a nonionic detergent, by renewed rinsing with hot and cold water and drying in a conventional manner. The result obtained is a strong deep red dyeing having very good use fastness properties.

EXAMPLE 11 a) 10 parts of a polyester/cotton blend fabric are treated at 30° C. for 15 minutes by a customary exhaust process in a liquor ratio of 10:1 with an aqueous solution containing 50 parts of polyethyleneimine (MW: 500), saturated with $CO_2$ and 20 parts of glyoxal per 1000 parts of water. The modified fabric was then thoroughly rinsed with cold and hot water, to which a commercial nonionic surfactant can be added, and once more with cold water.

b) The modified material can be introduced in the wet state into a single-bath dye process in a jet dyeing apparatus. For this 10 parts of modified blend fabric are heated in the apparatus with 0.1 part of a 50% strength electrolyte-containing fiber-reactive azo dye described in Example 1 of European Patent 0 032 187 and 0.1 part of the disperse dye of the formula

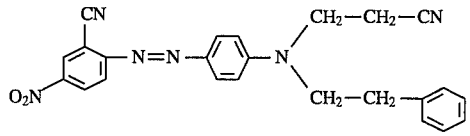

known from DE-A 2 363 376 in 200 parts of water to 60° C., held at that temperature for 15 minutes and subsequently heated to 130° C. After dyeing at 130° C. for 30 minutes, the bath is cooled down to 60° C. and the now colorless liquor is discharged, and the dyed material is washed in conventional manner, for example by rinsing with cold and hot water, by boiling treatment in a bath containing a nonionic detergent, by a renewed rinsing with water and drying.

The result obtained is a strong level red dyeing which in its fastness properties is in every point as good as the fastness properties of the dyes obtainable by the prior art processes.

EXAMPLE 12 a) A package of 30 parts of bleached cotton yarn is treated for 20 minutes at 30° C. in a yarn dyeing apparatus in 450 parts of an aqueous solution of 50 parts of polyethyleneimine (MW: 1000) and 30 parts of glyoxal in 1000 parts of water by pumping the liquor through the package in alternating directions. Thereafter the liquor is cooled down, and discharged, and the package is thoroughly rinsed with cold water.

b) After a renewed rinse with cold water the yarn on the package is subjected directly to a dyeing process:

The dyeing apparatus is charged with 450 parts of an aqueous dye solution containing 0.6 part of the fiber-reactive azo dye of the formula

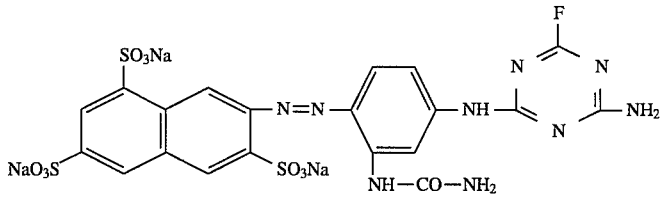

known from DE-A 2 840 380 and heated to 60° C. The dyeing takes place at 60° C. for 30 minutes by pumping the liquor through the package in alternating directions. Thereafter the yarn is finished on the package in the same way with cold and hot water, to which a nonionic detergent can be added, and by renewed rinsing with cold water. The result obtained is a level yellow dyeing on the fiber with the fastness properties which are good for the dye.

EXAMPLE 13

A cotton tricot is impregnated with a mixture consisting of an aqueous solution of 3% of polyethyleneimine (MW: 1000) and 1% of glyoxal in water in a washing machine. This is followed by a domestic wash with a heavy duty detergent at 60° C. to remove any yellowing. The knit thus obtained is tumble dried at 60° C.

The dried fabric is dyed analogously to a customary exhaust process:

100 parts of the modified fabric are introduced into 2000 parts by volume of an aqueous dye solution containing 2 parts of a 50% strength electrolyte(predominantly sodium chloride)-dye powder a) Direct Blue 108 (C.I. No. 51320) or b) Direct Blue 199 (GB-A-1046520).

The resulting dyeings are alternately rinsed hot and cold and dried. They have good fastness properties.

What is claimed is:

1. A process for modifying fiber materials, which comprises the steps of:

mixing a polymer selected from the group consisting of polyethyleneimine having a molecular weight from 500 to 2000 and a polypropyleneimine having a molecular weight from 500 –1000 with a bifunctional crosslinking agent of the formula (II)

$$Z—Q—Z \qquad (II)$$

where

Z is a group of the formula —CHO or $—CH(OR^1)_2$, wherein $R^1$ is in each case identically or differently hydrogen or $C_1$–$C_4$-alkyl, and Q is a phenylene group or a group of the formula $(—CH_2—)_a$, wherein a is from 0 to 4, in an aqueous solution to form an aqueous mixture, and bringing said aqueous mixture into contact with said fiber material.

2. The process of claim 1, wherein the bifunctional crosslinking agent of the formula (II) is glyoxal.

3. The process of claim 1, wherein the concentration of the polymers in said aqueous solution is from 1 to 30% by weight, and that of the compound of the formula (II) is from 0.5 to 20% by weight.

4. The process of claim 1, wherein the concentration of the polymers in said aqueous solution is from 2 to 20% by weight, and that of the compound of the formula (II) is from 1 to 10% by weight.

5. The process of claim 1, wherein the fiber materials are selected from the group consisting of polyester fiber materials, polyamide fiber materials, polyurethane fiber materials, cellulose fiber materials, and mixtures thereof.

6. The process of claim 5, wherein the fiber material is cotton.

7. A process for dyeing fiber materials with water-soluble, anionic dyes, which comprises the steps of:

providing a fiber material modified by the process as claimed in claim 1, and dyeing said modified fiber material using a low-electrolyte or completely electrolyte-free dyeing liquor or print paste.

8. The process of claim 7, wherein the dye is applied to the fiber material together with the compound of the formula (II) or in a subsequent separate step.

9. The process of claim 7, wherein the aqueous or aqueously alkaline solution contains from 0 to 20% by weight of NaOH or $Na_2CO_3$.

10. The process of claim 9, wherein the aqueous or aqueously alkaline solution contains from 0 to 5% by weight of NaOH or $Na_2CO_3$.

11. The process of claim 1, wherein the step of bringing said aqueous mixture into contact with said fiber material is effected by an exhaust method, a padding process, a spraying method, or an inkjet process.

12. The process of claim 7, wherein the water-soluble, anionic dye is a reactive dye.

13. A fiber material modified by a process as claimed in claim 1.

14. A fiber material dyed by a process as claimed in claim 7.

15. The process according to claim 1, wherein the fiber material is regenerated cellulose.

16. The process of claim 1, further comprising the step of bringing said modified fiber material into contact with a dye, wherein the step of bringing said dye into contact with said modified fiber material is effected by an exhaust method, a padding process, a spraying method, or an inkjet process.

17. A process for modifying fiber materials, which comprises the steps of:

a) providing a polymer selected from the group consisting of polyethyleneimine having a molecular weight from 500 to 2000 and a polypropyleneimine having a molecular weight from 500–1000, b) contacting said fiber with the polymer selected in step a, c) providing a compound of the formula (II)

$$Z—Q—Z \qquad (II)$$

where

Z is a group of the formula —CHO or $—CH(OR^1)_2$, wherein $R_1$ is in each case identically or differently hydrogen or $C_1$–$C_4$-alkyl, and Q is a phenylene group or a group of the formula $(—CH_2—)_a$, wherein a is from 0 to 4, and d) contacting the fiber with the compound of the formula II.

* * * * *